US006334411B1

(12) United States Patent
Lesage et al.

(10) Patent No.: US 6,334,411 B1
(45) Date of Patent: Jan. 1, 2002

(54) HIGH EFFICIENCY, GLASS-LINED, COMBINATION SPACE AND HOT WATER HEATER

(75) Inventors: Claude Lesage, Pointe Claire; Brian M. Lewis, Lachine, both of (CA)

(73) Assignee: Giant Factories Inc., Montreal (CA)

( * ) Notice: Subject to any disclaimer, the term of this patent is extended or adjusted under 35 U.S.C. 154(b) by 0 days.

(21) Appl. No.: 09/175,946

(22) Filed: Oct. 21, 1998

(51) Int. Cl.[7] ..... F22B 13/02

(52) U.S. Cl. ..... 122/18.1; 122/18.31; 122/19.1; 122/367.1

(58) Field of Search ..... 122/14, 17, 13.1, 122/367.1, 367.2, 367.3, 13.01, 18.1, 18.3, 18.31, 19.1; 392/441, 444, 446, 447, 456, 457, 461; 237/8 R, 16, 70

(56) References Cited

U.S. PATENT DOCUMENTS 2,202,495 A * 5/1940 Juzi ..... 122/379
3,105,137 A * 9/1963 Sullivan et al. ..... 237/8 R
3,891,817 A * 6/1975 Brown ..... 237/16
4,222,350 A * 9/1980 Pompei et al. ..... 122/32
4,479,484 A * 10/1984 Davis ..... 126/362
4,479,605 A * 10/1984 Billotte et al. ..... 237/8 R
4,823,770 A * 4/1989 Loeffler ..... 126/362
5,165,472 A * 11/1992 Cloutier ..... 165/159
5,365,888 A * 11/1994 Aronov ..... 122/19
5,485,879 A * 1/1996 Lannes ..... 122/14
5,735,237 A * 4/1998 Phillip et al. ..... 122/13.1
5,816,199 A * 10/1998 Khizh et al. ..... 122/367.1
5,839,655 A * 11/1998 Iritani ..... 237/8 A

* cited by examiner

*Primary Examiner*—Jiping Lu
(74) *Attorney, Agent, or Firm*—Swabey Ogilvy Renault; Guy J. Houle

(57) ABSTRACT

A combination space and hot water heater is comprised of an inner tank having an outer casing spaced therebout with insulation being interposed between the casing and the inner tank. The inner tank has a glass-lined inner surface and a heater is provided within the inner tank for heating a same volume of water within the inner tank. An anode is provided within the inner tank. A closed water circulating circuit is connected to the inner tank for circulating hot water from the tank through heat exchange means connected in the closed water circulating circuit. Preferably, but not exclusively, the heat exchange devices are radiators. The inner tank contains a predetermined same volume of recirculating water wherein minimal deposits are accumulated in the inner tank by not admitting fresh water thereby substantially preventing the build-up of deposits on heat exchange elements within the tank and the formation of harmful bacteria in radiators and corrosion and further wherein a high constant efficiency is achieved and the life expectancy of the hot water heater is substantially prolonged. At least one heat exchange coil is disposed in the inner tank and immersed in the water contained therein. The heat exchange coil is connected at one end to an outlet coupling to which a domestic hot water line is connected. An opposed end of the heat exchange coil is connected to an inlet coupling. The inlet coupling is connected to a pressurized water supply.

10 Claims, 3 Drawing Sheets

HIGH EFFICIENCY, GLASS-LINED, COMBINATION SPACE AND HOT WATER HEATER

TECHNICAL FIELD

The present invention relates to a high efficiency glass-lined combination space and hot water heater provided with a closed circulating circuit through which a predetermined volume of water is circulated and maintained within the tank. The combination heater of the present invention substantially prevents the build-up of deposits and corrosion. Accordingly, a high constant efficiency heater is achieved and the life expectancy of the heater is substantially prolonged. The hot water heater of the present invention provides both space heating and potable domestic hot water.

BACKGROUND ART

Indirect water heaters are well known in the art wherein a coil is placed within a hot water tank to which city water is fed at one end of the coil and exits at the other end to feed a domestic hot water supply. The hot water within the tank is also fed city water which is heated and used for domestic application such as washing or bathing, whereas the water within the coil is used for consumption or other specific applications such as for heating baseboards connected to a water convection circuit. With glass-lined water heaters which are continuously fed city water, the reservoir and heating coil is continuously bombarded with deposits including calcium, silicas, silts and ferrous materials. This causes several problems such as the formation of bacteria within the coil of the radiators when the water is stagnant therein. In radiators, the water could be stagnant for long periods of time as these are not utilized during the summer months. Accordingly, bacteria will build up during the hot summer months and when the system is placed back in use, these bacterias are flushed back into the tank. If the water within the tank is utilized for bathing or other use where the human body is in contact with such water, then this contaminated water could inflict serious disease to the user. Legionella is known to occur if stagnant water is mixed with potable water. This can occur in summer months when water is stagnant in old casted water heaters which are disposed in hot rooms and exposed to direct sunlight. If such stagnant water is mixed with potable water it could prove deadly to human beings. This risk is amplified if the city water does not contain the proper quantity of chlorine. A further disadvantage is that the build-up of calcium on the glass-lined surface as well as the heat transfer surface and coils greatly affects the efficiency of the heater.

U.S. Pat. No. 5,165,472 describes a heat exchanger having fluid injectors therein to maintain the hot water in continuous agitation and this has been found suitable to prevent the formation of deposits on the glass lining of the tank as well as on the heat transfer coils. However, because the system is fed fresh water, deposits and water contamination problems will occur in the heating radiators. The patent is more concerned with the elimination of dead zones or dead spots which cause sediment deposits. A further disadvantage is that these systems corrode the copper pipes due to the use of acid water which contains CO2 and these copper pipes can deteriorate within short periods of time such as five years. Accordingly, such heaters cannot be adapted to old radiator systems which are more fragile and which require hot water in the range of 190° F.–200° F.

Combination water heating and space heating apparatus utilizing the hot water from the same tank is described in U.S. Pat. No. 5,544,645. As described the water heating unit and the space heating unit are coordinately controlled such that priority is given to the potable hot water supply over space heating in the event that sufficient hot water is not available to satisfy both demands. Accordingly, all of the above-mentioned disadvantages of the prior art are exemplified by this type of apparatus. A still further example of a combination water heating and space heating apparatus is described in U.S. Pat. No. 4,222,350.

SUMMARY OF INVENTION

It is a feature of the present invention to provide a high efficiency, glass-lined, combination space and hot water heater which substantially overcomes the above-mentioned disadvantages of the prior art and wherein life-expectancy is greatly improved.

Another feature of the present invention is to provide a high efficiency, glass-lined, combination space and hot water heater having a closed water circulating circuit connected to radiators for producing heat and wherein the water consists of a predetermined volume which is continuously circulated during use and wherein the water is substantially free of sedimentary, corrosive and other harmful products.

Another feature of the present invention is to provide a high efficiency, glass-lined, combination space and hot water heater having one or more heat exchange coils therein in contact with the hot water for producing domestic hot water independently of the water circulated in the closed circuit.

Another feature of the present invention is to provide a high efficiency, glass-lined combination space and hot water heater providing substantially unobstructed heat transfer and having a longer life expectancy than prior art water heaters for such use.

According to the above features, from a broad aspect, the present invention provides a high efficiency, glass-lined, combination space and hot water heater which comprises an inner tank. An outer casing is spaced about the inner tank and insulation is provided between the outer casing and the inner tank. The inner tank has a glass-lined inner surface. Heater means is provided for heating a predetermined volume of water within the inner tank. An anode extends within the inner tank. A closed water circulating circuit is connected to the inner tank for circulating hot water from the inner tank. Heat exchange means is connected in the closed water circulating circuit. A pump is connected to the closed water circulating circuit for convecting hot water from the inner tank through the heat exchange means. The predetermined volume of recirculating water provides for minimal deposits to accumulate in the inner tank thereby substantially preventing the build-up of deposits on heat exchange elements within the tank and the formation of harmful bacteria and corrosion and further wherein high constant efficiency is achieved and the life expectancy of the hot water heater is substantially prolonged. At least one heat exchange coil is disposed in the inner tank and immersed in the water contained therein. The heat exchange coil is connected at one end to an outlet coupling to which a domestic hot water line is connected. An opposed end of the heat exchange coil is connected to an inlet coupling. The inlet coupling is connected to a pressurized water supply.

BRIEF DESCRIPTION OF DRAWINGS

A preferred embodiment of the present invention will now be described with reference to the examples thereof as illustrated in the accompanying drawings in which.

DESCRIPTION OF PREFERRED EMBODIMENTS

Figure 1:
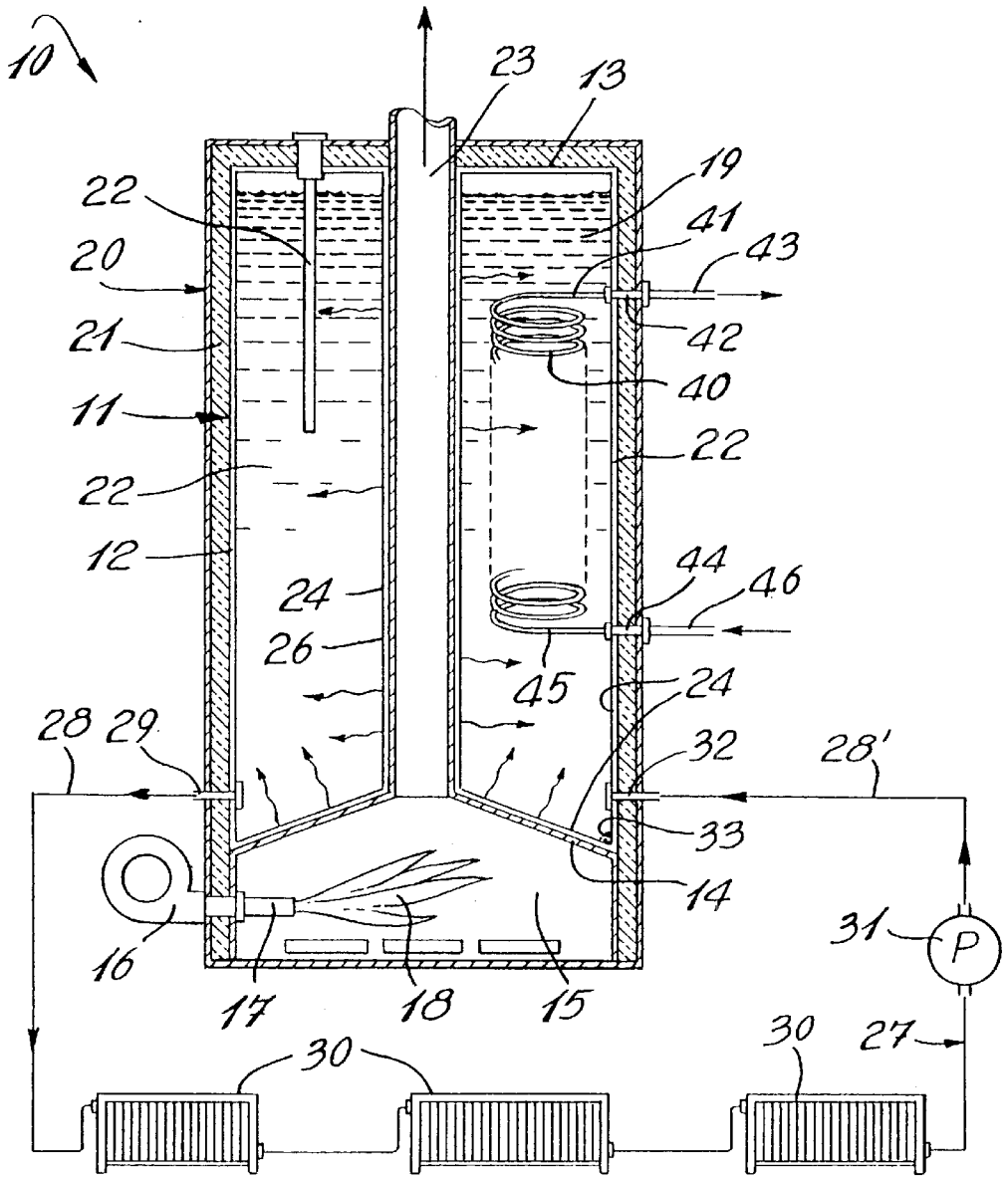
FIG. 1 is a cross-sectional schematic view of a high efficiency, glass-lined, combination space and hot water heater using a gas or oil burner and constructed in accordance with the present invention and connected to a closed loop water circulating circuit and illustrating the optional use of one or more heat exchange coils provided in the inner tank to supply hot domestic water.

Referring to the drawings and more particularly to FIG. 1, there is shown generally at 10 one example of a high efficiency, glass-lined, combination space and hot water heater constructed in accordance with the present invention. It consists essentially of an inner tank 11 having a cylindrical side wall 12, a top wall 13 and a bottom wall 14. A combustion chamber 15 is provided below the bottom wall. A gas or oil burner 16 is connected to the side wall and has a combustion nozzle 17 extending within the combustion chamber 15 to produce a flame 18 therein to provide a heat source to heat the same predetermined volume of water 19 contained within the inner casing 12. The tank 11 is not continuously fed by the city water supply and accordingly does not use fresh water which contains sedimentary particles.

An outer casing 20 is secured about the inner casing 11 and an insulating material, such as wool or foam insulation 21 is disposed between the outer wall of the inner tank and the inner surface of the outer casing. An anode 22 is secured in the inner casing and extends within the inner chamber 22 in contact with the water 19 contained therein, to protect the tank from the corrosive effects of hot water, as is well known in the art.

As hereinshown a flue pipe 23 extends from the combustion chamber 15 and exits through the top wall 13 of the tank to release products of combustion into outside atmosphere. The inner side wall as well as the inner surface of the bottom wall 14 of the tank are lined with a glass lining 24, as is also well known in the art. The flue pipe 23 also has a glass lining 24 thereabout and the top wall 13 may also be glass-lined. As hereinshown the same predetermined volume of water 19 within the inner chamber 22 is heated by heat transfer between the bottom wall 14 and the cylindrical side wall 26 of the flue pipe 23.

A low-pressure closed water circulating circuit 27 operating within the range of from about 5 to 35 psi is connected to the inner tank 11 and it consists of a conduit 28 usually constituted by copper piping connected to an outlet coupling 29. One or more heat exchange means, herein baseboard heaters or radiators 30, are secured to the closed circuit either in series, as hereinshown, or in parallel, so that the hot water from the inner chamber 22 of the inner tank is convected therethrough to generate heat to warm a space. A pump 31 circulates the water within the closed water circulating circuit 27 with the return conduit 28' being connected to the inlet coupling 32.

It is important to note that the inner chamber 22 contains the same predetermined volume of water which is continuously heated and recirculated. Therefore, fresh water is not continuously added to the inner tank. The advantage of this is that a predetermined small volume of deposits will take place when the heater is initially placed in use and small deposit only may accumulate in the corners 33 between the cylindrical side wall 12 of the inner tank and the bottom wall 14 and will substantially not interfere with the heat transfer surfaces. If fresh water was admitted in the inner tank the sedimentary deposits would continue to build up over the bottom wall and greatly reduce the efficiency of this heat transfer. Also, hard fresh water is known to have sedimentary material such as calcium, silicas, silts and ferrous materials and some of these products cause oxidation of exposed metal even through a pin hole in the glass lining. The anode 22 substantially reduces this corrosive effect but seeing that the volume of water is always the same volume, it cleanses itself and the chance of corrosion taking place is practically eliminated. Also, if harmful bacteria was to originate in the radiators 30 during stagnant periods, these bacterias would have no effect on the potable heated water which is not mixed with the volume of water in the tank. Usually, known combo systems have a life expenctancy of 5–6 years whereas with the present invention the life expectancy is extended to about from 25–35 years.

Figure 2:
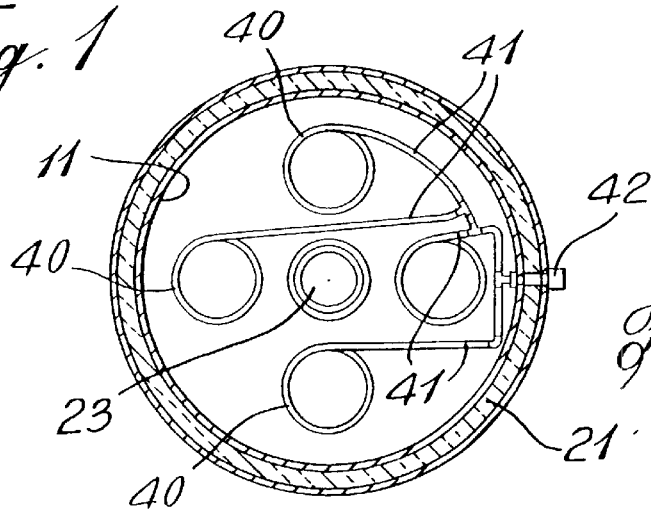
FIG. 2 is a section view showing the disposition of the one or more heat exchange coils.

In the specific embodiment as shown in FIG. 1, domestic hot water is supplied by providing one or more, herein four, heat exchange coils 40 as shown in FIGS. 1 and 2. These heat exchange coils are immersed in the predetermined volume of hot water contained within the inner chamber 22. The coils 40 are connected at one end, herein 41, to an outlet coupling 42 to which a domestic hot water line 43 is connected. An inlet coupling 44, to which an opposed end 45 of the heat exchange coils 40 is connected, supplies pressurized water from the city supply conduit 46 which is pressured at about 65 psi. Because of the use of the same predetermined volume of hot water, there will not be any build-up of deposits on the heat exchange coils 40 and substantially 100% heat transfer is achieved. This permits for a supply of hot domestic water at a constant temperature and at high efficiency per b.t.u. Accordingly, the hot water heater of the present invention can be adapted to old steel-casted radiators where there is a need to supply hot water at constant high temperatures in the range of from about 190° to 200° F. If one of the coils was to puncture, then the potable water would flow into the tank due to the difference in pressure. This would cause the relief valve of the tank to release water indication that a coil is defective and the coil assembly would be changed or else the combo unit replaced if it has been in operation up to its life expectancy.

Figure 3:
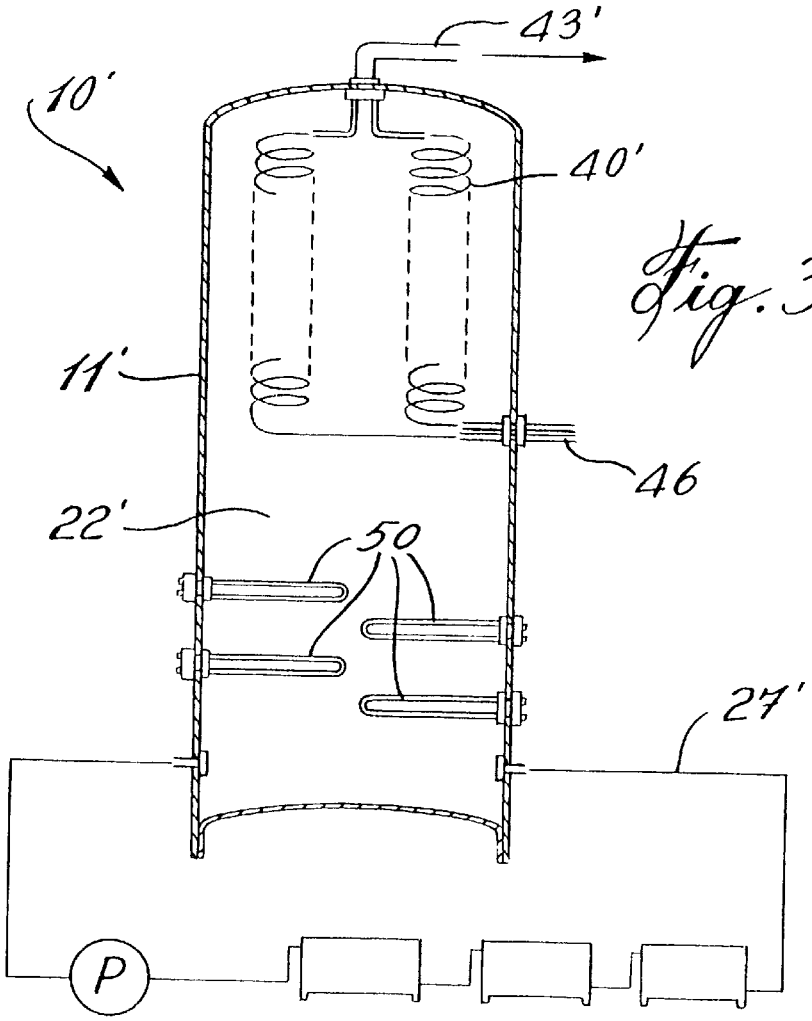
FIG. 3 is another cross-sectional schematic view of a high efficiency, glass-lined, combination space and hot water heater constructed in accordance with the present invention and wherein the heating means is constituted by electric resistive elements.
Figure 4:
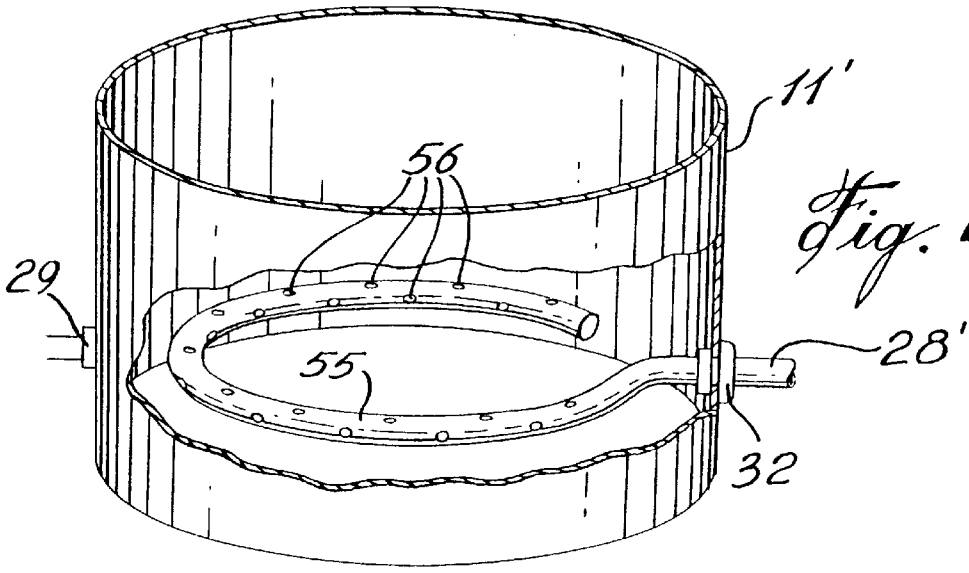
FIG. 4 is a fragmented perspective view showing an agitating conduit disposed adjacent the bottom wall of the water heater for agitating the hot water therein.

FIG. 3 illustrates a further embodiment of the high efficiency, glass-lined hot water heater 10' of the present invention. As hereinshown, the heat source is provided by one or more, herein four, electric resistive heating elements 50 extending within the inner chamber 22' of the inner tank 11'. Although not shown the inner tank is protected by an outer casing and insulation as shown in FIG. 1. The closed water circulating circuit 27' is similarly connected to the inner chamber 22' of the inner tank 11' as with the embodiment described in FIG. 1. A plurality of heat exchange coils 40' may also be conveniently disposed within the inner chamber 22' to feed the domestic hot water supply line 43'.

If desirable to enhance heat transfer, there may be provided at the bottom of the inner tank 11 or 11' an agitating means in the form of a partly circular conduit-like chamber 55 provided with orifices 56 therein oriented at predetermined angles to agitate the water within the inner chamber 22 or 22'. This agitating chamber would be connected to the return line 28' of the closed water circulating circuit 27 as shown in FIG. 1. A similar agitating means is described in U.S. Pat. No. 5,165,472 referred to hereinabove and is shown herein as an auxiliary or optional device that may be connected at the base of the inner tank to obtain some of the benefits as described in the aforesaid patent.

Figure 5:
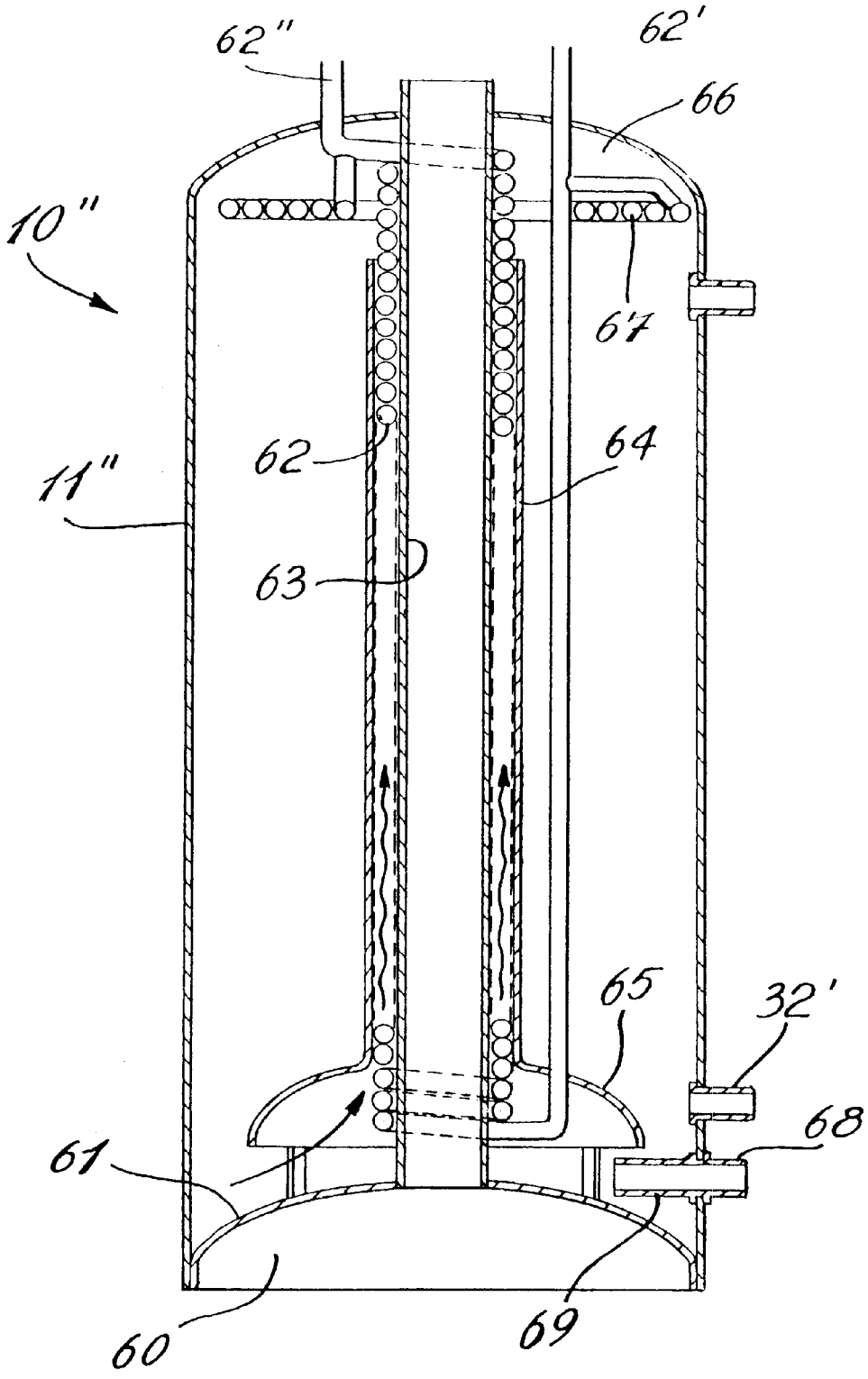
FIG. 5 is a section view illustrating a still further embodiment of the present invention.

Referring to FIG. 5 there is shown a still further embodiment of the high efficiency combination space and hot water heater of the present invention and generally indicated by reference numeral 10". As hereinshown the water heater is a gas heater provided with a combustion chamber 60 at the base thereof adjacent the bottom wall 61 whereby to provide heat to heat the water contained within the inner tank 11". A heat exchange coil 62 is wound along a major portion of the flue pipe 63 and has an inlet end 62' and an outlet end 62" exiting from the top of the tank. The inlet end 62' connects to the base portion of the heat exchange coil 62 so that the potable water as it enters the coil is heated as it is convected spirally from the base of the hot water heater to the top portion of the hot water heater.

A tubular sleeve 64 is formed about at least a major portion of the heat exchange coil 62 and spaced from the flue pipe 63 to define an annular jacket about the flue pipe to retain heat, thus acting as a super heater. The base of the tubular sleeve 64 is provided with a skirt portion 65 which is spaced above the bottom wall 61 to channel the water heated against the bottom wall 61 into the annular jacket. The tubular sleeve 64 is spaced a predetermined distance to provide for the water to shoot up into this annular jacket, thus providing an upward convection of hot water from the bottom wall 61 to the top portion 66 of the inner tank 11". The water temperature at the bottom portion of the tank is at about 140° F. and at the top it rises to about 175° F.

As hereinshown a further spiral heat exchange coil 67 can be supported horizontally in the top portion 66 of the inner tank 11" and connected to the inlet and outlet pipes 62' and 62" whereby to extract further heat from the hot water within the tank and particularly in the top portion 66 where the water is hotter than in the bottom section when the closed water circulating circuit 27 is not in use. When the pump 31 is operated to circulate hot water through the closed circulating circuit, then the water temperature in the tank is fairly constant throughout the tank.

The inlet coupling 32' connected to the inner tank could also be located in a lower portion as indicated by reference numeral 68 and have an extension pipe 69 extending within the inner tank 11' and directly under the annular skirt 65 so that the cooled return water from the closed circuit can be warmed quickly as it moves up into the annular jacket where it is superheated.

This particular embodiment as shown in FIG. 5 for use with gas or oil burners has been found to be extremely efficient as a combination space and hot water heater.

Those skilled in the art will appreciate that the conception upon which this disclosure is based may readily be utilized as a basis for the designing of other structures and systems for carrying out the several purposes of the present invention. It is important, therefore, that the claims be regarded as including such equivalent constructions insofar as they do not depart from the spirit and scope of the present invention.

What is claimed is:

1. A combination space heating and potable hot water heater comprising an inner tank, an outer casing spaced about said inner tank, insulation between said inner tank and said outer casing, said inner tank having a glass lined inner surface, heater means for heating a predetermined volume of water within said inner tank, said heater means being a burner secured to said tank and having a burner nozzle extending in a bottom combustion chamber in contact with a bottom wall of said inner tank, a flue pipe extending vertically through said inner tank and communicating with said bottom combustion chamber, said bottom wall and said flue heating said water by heat transfer, an anode within said tank, a closed water circulating circuit connected to said inner tank for circulating said predetermined volume of hot water from said inner tank, heat exchange means connected in said closed water circulating circuit, a pump connected to said closed water circulating circuit for convecting said same volume of hot water from said inner tank through said heat exchange means, said predetermined volume of recirculated water through said heat exchange means providing for minimal deposits to accumulate in said inner tank thereby substantially preventing the build-up of deposits in said heat exchange means and further preventing the formation of harmful bacteria and corrosion in said tank thereby achieving a high constant efficiency and a substantial increase in the life expectancy of the hot water heater, at least one heat exchange coil disposed in said inner tank and immersed in said water contained therein, said heat exchange coil being connected at one end to an outlet coupling to which a domestic hot water line is connected, an inlet coupling to which an opposed end of said heat exchange coil is connected, said inlet coupling being connected to a pressurized water supply, said heat exchange coil being heated by said predetermined volume of water to heat domestic water in a conduit circuit independent of said closed water circulating circuit whereby said domestic water is prevented from contamination by said water in said tank which may contain bacteria formed in said heat exchange means when said pump is inoperative, said heat exchange coil being wound along a major portion of said flue pipe, a tubular sleeve formed about at least a major portion of said heat exchange coil and spaced from said flue pipe to define an annular jacket about said flue pipe to retain heat and providing for an upward connection of hot water from said bottom wall and about said heat exchange coil.

2. A hot water heater as claimed in claim 1 wherein said burner is a gas or oil burner.

3. A hot water heater as claimed in claim 1 wherein there is further provided agitating means within a lower portion of said inner tank to agitate said water therein.

4. A hot water heater as claimed in claim 3 wherein said agitating means is comprised by a conduit-like chamber having orifices therein to produce water jets, said chamber being connected to a return pipe of said closed water circulating circuit.

5. A hot water heater as claimed in claim 1 wherein said deposits include calcium, silica, silts and ferrous materials usually contained in pressurized city water supplies.

6. A hot water heater as claimed in claim 1 wherein there are two or more of said heat exchange coils.

7. A hot water heater as claimed in claim 1 wherein said tubular sleeve is provided with a bottom skirt portion spaced above said bottom wall to direct said hot water into said annular jacket.

8. A hot water heater as claimed in claim 7 wherein an inlet pipe is connected to said inner tank and extends under said skirt, said inlet pipe being connected to a return conduit of said closed water circulating circuit.

9. A hot water heater as claimed in claim 1 wherein water adjacent said bottom wall is heated to a temperature of about 140° F.

10. A hot water heater as claimed in claim 1 wherein a further spiral heat exchange coil is supported horizontally in a top portion of said inner tank about said flue pipe, said inlet and outlet coupling being connected respectively to an inlet and outlet of both said heat exchange coils.

* * * * *